US008950904B2

(12) United States Patent
Cavenati et al.

(10) Patent No.: US 8,950,904 B2
(45) Date of Patent: Feb. 10, 2015

(54) SHAPING ASSEMBLY FOR SHAPING A LIGHT BEAM AND STAGE LIGHT FIXTURE COMPRISING SAID SHAPING ASSEMBLY

(75) Inventors: Angelo Cavenati, Brusaporto (IT); Pasquale Quadri, Torre de' Roveri (IT)

(73) Assignee: Clay Paky S.p.A., Seriate (IT)

( * ) Notice: Subject to any disclaimer, the term of this patent is extended or adjusted under 35 U.S.C. 154(b) by 281 days.

(21) Appl. No.: 13/047,208

(22) Filed: Mar. 14, 2011

(65) Prior Publication Data

US 2011/0222290 A1 Sep. 15, 2011

(30) Foreign Application Priority Data

Mar. 15, 2010 (IT) ..... MI2010A0413

(51) Int. Cl.

| | |
|---|---|
| ***F21V 17/02*** | (2006.01) |
| ***B60Q 3/00*** | (2006.01) |
| ***F21V 11/18*** | (2006.01) |
| *F21V 14/08* | (2006.01) |
| *F21W 131/406* | (2006.01) |

(52) U.S. Cl.

CPC ..... *F21V 11/18* (2013.01); *F21V 14/08* (2013.01); *F21W 2131/406* (2013.01)

USPC ..... 362/319; 362/321; 362/539

(58) Field of Classification Search

CPC ... F21W 2131/406; F21V 11/18; F21V 11/10

USPC ..... 362/321, 319, 18, 539, 277, 281, 283, 362/284, 306, 322–324, 16, 512, 513, 280

See application file for complete search history.

(56) References Cited

U.S. PATENT DOCUMENTS

| | | | | |
|---|---|---|---|---|
| 5,161,979 | A * | 11/1992 | Sekiguchi | 434/365 |
| 5,788,365 | A * | 8/1998 | Hunt et al. | 362/301 |
| 6,744,693 | B2 * | 6/2004 | Brockmann et al. | 362/321 |
| 7,600,891 | B2 * | 10/2009 | Belliveau et al. | 362/231 |
| 7,600,892 | B2 * | 10/2009 | Belliveau et al. | 362/231 |
| 2004/0125602 | A1 * | 7/2004 | Hunt et al. | 362/293 |
| 2004/0252504 | A1 * | 12/2004 | Foster | 362/253 |
| 2007/0285925 | A1 * | 12/2007 | Hough | 362/268 |
| 2008/0192475 | A1 * | 8/2008 | Salm | 362/277 |
| 2009/0109680 | A1 * | 4/2009 | Belliveau et al. | 362/277 |
| 2009/0109681 | A1 * | 4/2009 | Jurik | 362/284 |
| 2009/0122548 | A1 * | 5/2009 | Dalsgaard | 362/282 |
| 2009/0196043 | A1 * | 8/2009 | Calmes | 362/278 |

FOREIGN PATENT DOCUMENTS

| | | |
|---|---|---|
| WO | WO 03/023513 | 3/2003 |
| WO | WO 03/093725 | 11/2003 |
| WO | WO 2007134609 | 11/2007 |

* cited by examiner

*Primary Examiner* — David J Makiya
*Assistant Examiner* — Bryon T Gyllstrom
(74) *Attorney, Agent, or Firm* — Leason Ellis LLP

(57) ABSTRACT

A shaping assembly for shaping a light beam extending along an optical axis is equipped with:

a support frame extending about a longitudinal axis;

a plurality of screen elements supported by the support frame and arranged transversally with respect to the axis;

a plurality of pairs of actuators, each of which is coupled with a respective screen element; each actuator comprising at least a moving device and transmission means, which are configured to transmit the movement of the moving device to the respective screen element and comprise at least one rod-crank type mechanism.

17 Claims, 4 Drawing Sheets

SHAPING ASSEMBLY FOR SHAPING A LIGHT BEAM AND STAGE LIGHT FIXTURE COMPRISING SAID SHAPING ASSEMBLY

The present invention relates to a shaping assembly for shaping a light beam and to a stage light fixture comprising said shaping assembly.

BACKGROUND OF THE INVENTION

As known, shaping assemblies for shaping a light beam are normally used in stage light fixtures to modify the transversal sections of the light beam.

The stage light fixtures of known type comprise a casing, a light source arranged within the casing at a closed end of the casing and adapted to emit a light beam substantially along an optical axis, an objective lens arranged at an open end of the casing and a shaping assembly for shaping the light beam emitted by the light source, arranged between the light source and the objective lens.

The shaping assemblies of known type generally comprise at least one movable screen element, which may be variably positioned so as to intercept different parts of the light beam and vary the shape of the transversal section of the light beam exiting from the shaping assembly.

Patent IT 1326350 entitled to the applicant describes a shaping assembly comprising a support body extending about an axis and equipped with an opening crossable by the light beam; a plurality of screen elements arranged transversally with respect to the axis; and a plurality of actuators, each of which is coupled with a respective screen element and comprises an electric motor and movement transmission means, coupled with the motor and the screen element.

However, this type of shaping assembly is too cumbersome for next generation stage light fixtures. Indeed, over the last few years the need has significantly increased to minimize the volumes of the light fixtures and consequently of all devices adapted to processing the light beam, which also includes the shaping assembly.

Indeed, there exist shaping assemblies of known type characterized by a significant packing of the components precisely due to the need to minimize the overall volume. However, these shaping assemblies have limited maneuvering freedom of the screen elements. Indeed, due to this packing, the spaces available for the movable components (screen elements and movement transmission means) are highly reduced and consequently the possible movements are strongly limited and such that, for example, it is not possible to form triangles with variable area and concentric triangles, with the light beam.

SUMMARY OF THE INVENTION

It is an object of the present invention to make a shaping assembly that is free from the drawbacks herein noted from the known art; in particular, it is an object of the finding to make a shaping assembly having smaller dimensions with respect to the shapers of known art and capable of ensuring maximum maneuvering freedom of the screen elements.

In accordance with such objects, the present invention relates to a shaping assembly for shaping a light beam as claimed in the attached claims.

It is a further object of the finding to make a stage light fixture having a smaller volume with respect to known stage light fixtures.

In accordance with such objects, the present invention relates to a stage light fixture as claimed in the attached claims.

BRIEF DESCRIPTION OF THE DRAWINGS

Further features and advantages of the present invention will become apparent from the following description of a non-limiting embodiment thereof, with reference to the figures of the accompanying drawings, in which.

DETAILED DESCRIPTION OF THE INVENTION

Figure 1:
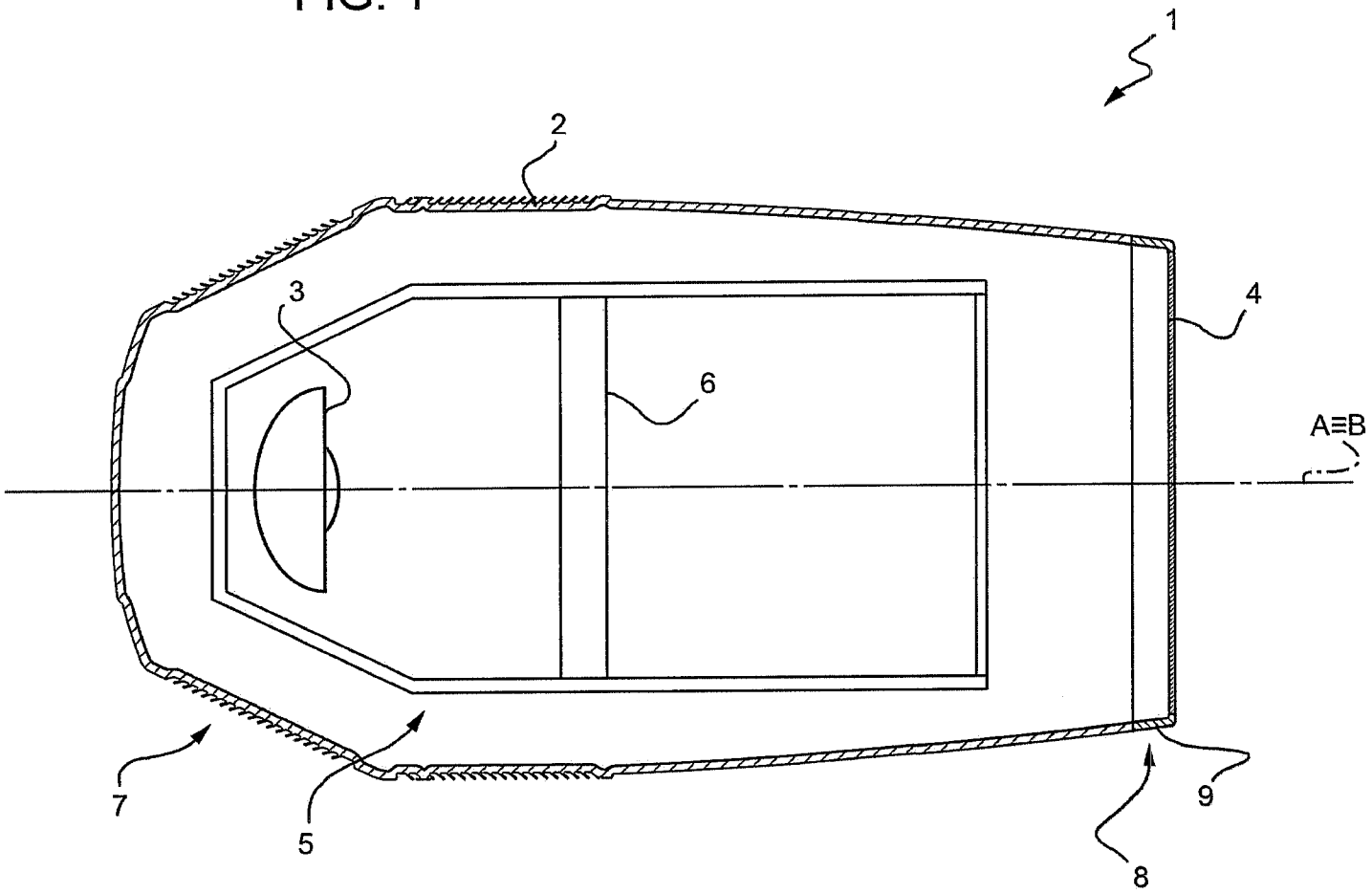
FIG. 1 is a diagrammatic side view with sectional parts and parts removed for clarity, of a stage light fixture according to the present invention.

FIG. 1 indicates a stage light fixture with reference number 1, comprising a casing 2, a light source 3, an objective lens 4, a frame 5 and a shaping assembly 6 (diagrammatically illustrated in FIG. 1).

Casing 2 extends along a longitudinal axis A and has a closed end 7 and an open end 8 opposite to the closed end 7 along axis A.

Preferably, casing 2 is supported by support means (not illustrated in the accompanying figures for simplicity). In particular, the support means and casing 2 are configured to allow casing 2 to rotate about two orthogonal axes, commonly called PAN and TILT.

The light source 3 is arranged within casing 2, at the closed end 7 of casing 2, is supported by frame 5, and is adapted to emit a light beam substantially along an optical axis B.

In the non-limiting example here described and illustrated, the optical axis B coincides with the longitudinal axis A of casing 2.

The objective lens 4 is circular and is fixed to the open end 8 of casing 2 so as to be centred on the optical axis B and to close casing 2. In particular, the objective lens 4 is fixed to a support ring 9, which in turn is coupled with casing 2, for example by means of screws (not illustrated in the accompanying figures for simplicity).

The shaping assembly 6 is arranged within casing 2 between the light source 3 and the objective lens 4 and is supported by frame 5.

Figure 2:
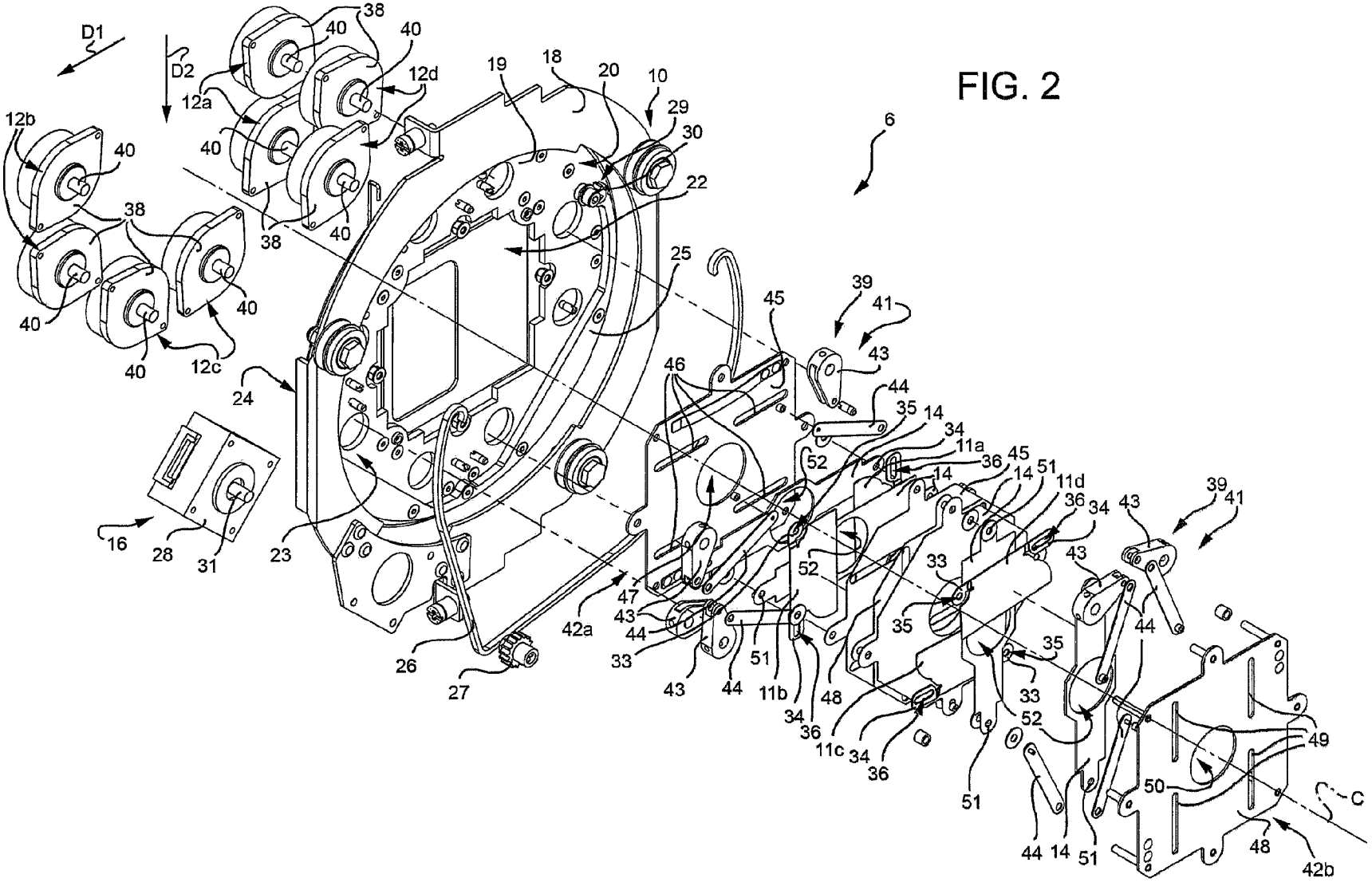
FIG. 2 is an exploded perspective view with parts removed for clarity, of a stage light fixture according to the invention.

With reference to FIG. 2, the shaping assembly 6 comprises a support frame 10, four screen elements 11*a*, 11*b*, 11*c*, 11*d*, four pairs of actuators 12*a*, 12*b*, 12*c*, 12*d*, each of which is coupled with a respective screen element 11*a*, 11*b*, 11*c*, 11*d*, six separating elements 14 and movement means 16 for moving the support frame 10.

The support frame 10 comprises a fixed plate 18 and a mobile plate 19.

The fixed plate 18 is annular-shaped and extends about its own axis of symmetry C, which, in use, preferably coincides with the optical axis A of the light beam and is coupled with the frame 5 (not illustrated in FIG. 2) in a position between the light source 3 and the objective lens 4. Moreover, the fixed plate 18 has a central opening 20 for housing the mobile plate 19.

Figure 3:
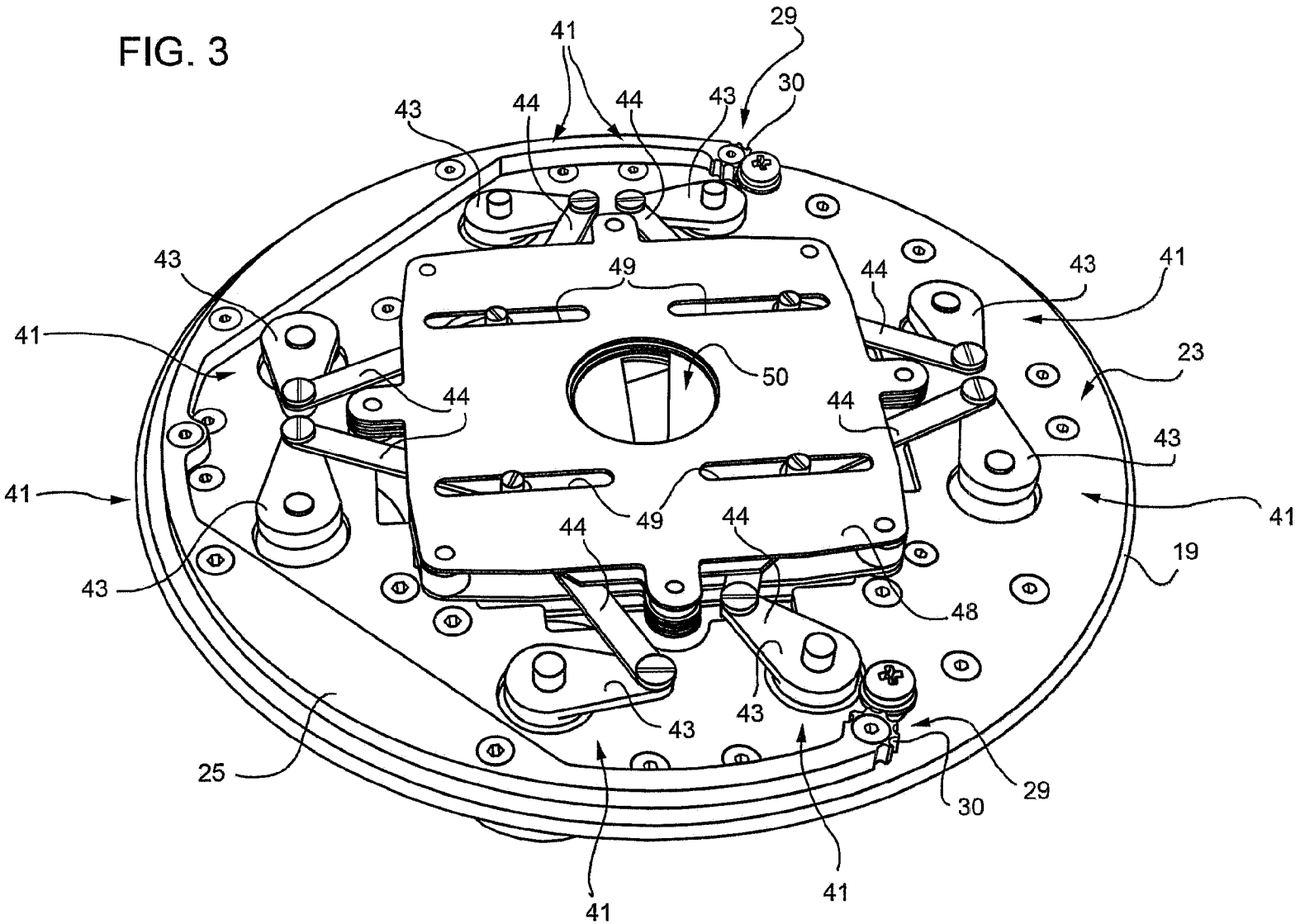
FIG. 3 is a front perspective view with parts removed for clarity, of the shaping assembly in FIG. 2.
Figure 4:
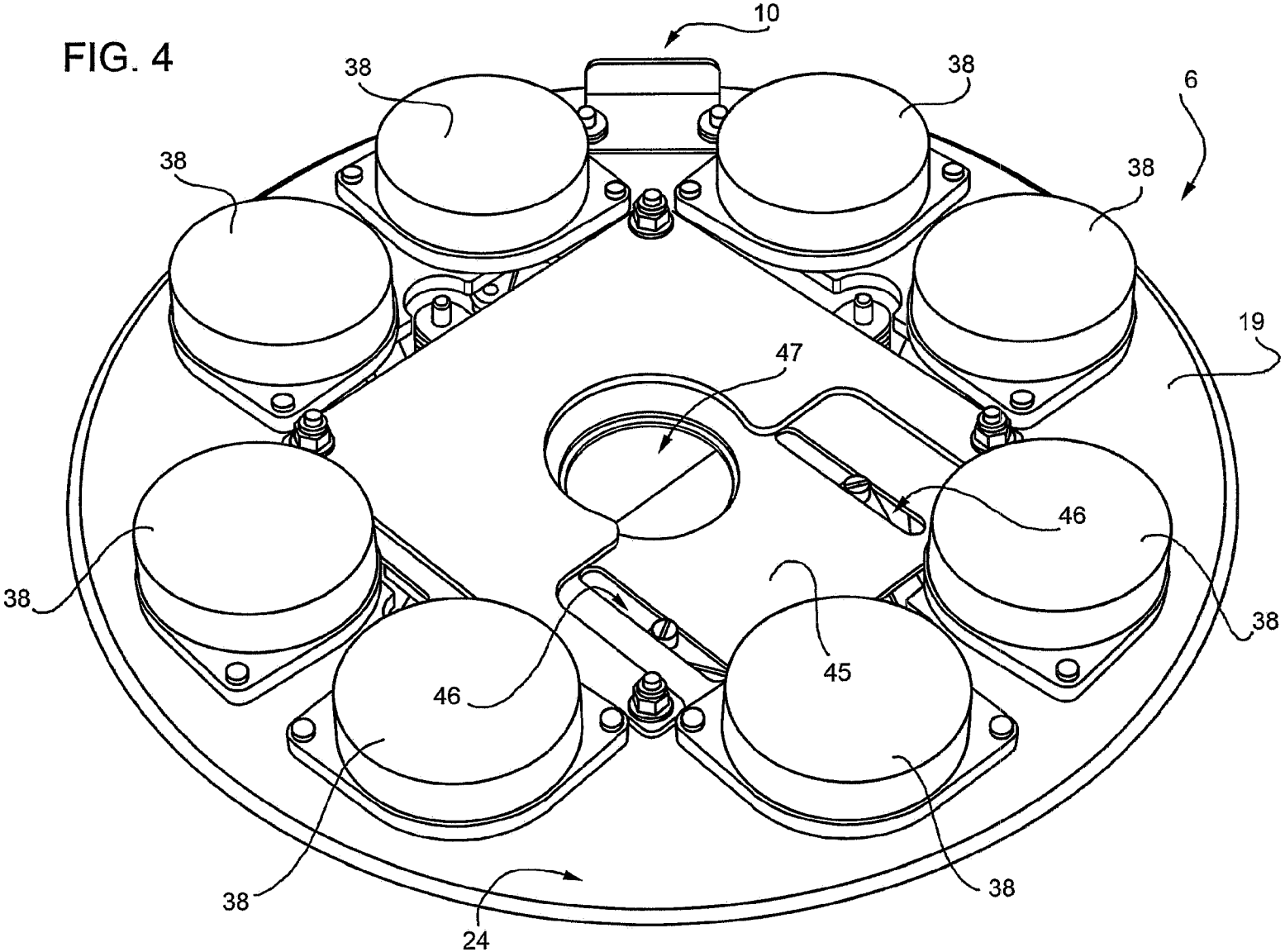
FIG. 4 is a rear perspective view with parts removed for clarity, of the shaping assembly in FIG. 2.

With reference to FIGS. 2, 3 and 4, the mobile plate 19 has a substantially circular shape, is equipped with a substantially rectangular central hole 22 for the light beam passage, and has a first face 23 and a second face 24.

The mobile plate 19 is rotatingly supported by the fixed plate 18. In particular, the mobile plate 19 is supported so that the central hole 22 is centred on the axis of symmetry C of the fixed plate 18 and rotates about axis C due to movement means 16. In the non-limiting example here described and illustrated, the movement means 16 comprise a hooking element 25, a transmission belt 26, a toothed wheel 27 and an electric motor 28.

The hooking element 25 is coupled with the mobile plate 19, in particular with the first face 23 of the mobile plate 19, and extends along an arc-path in proximity of the edge of the mobile plate 19.

Moreover, the hooking element 25 has two ends 29 respectively equipped with a circular toothed part 30.

The electric motor 28 (only shown in FIG. 2) is supported by the fixed plate 18 and is equipped with a rotating shaft 31, which is coupled with the toothed wheel 27. The transmission belt 26 is fixed to the ends of the circular toothed parts 30 and is dragged by the toothed wheel 27.

The screen elements 11*a*, 11*b*, 11*c*, 11*d* are arranged along respective distinct planes and orthogonal to axis C.

In greater detail, a first and a second screen element 11*a*, 11*b* are arranged from the side of the first face 23 of the mobile plate 18 and are movable in their respective planes, substantially in a direction D1, while a third and a fourth screen element 11*c*, 11*d* are again arranged from the side of the first face 23 of the mobile plate 19 and are movable in their respective planes, substantially in a direction D2, which is perpendicular to direction D1.

The planes along which the screen elements 11*a*, 11*b*, 11*c*, 11*d* are movable are arranged in succession along axis C.

The screen elements 11*a*, 11*b*, 11*c*, 11*d* have a substantially semi-circular or semi-elliptical shape and are equipped with respective first and second coplanar connecting appendixes 33, 34, which extend from opposite sides.

Each appendix 33 is equipped with a hole 35, while each appendix 34 is equipped with a slot 36.

Slot 36 of the first and of the second screen element 11*a*, 11*b* extends orthogonally to direction D1.

Slot 36 of the third and of the fourth screen element 11*c*, 11*d* extends orthogonally to direction D2.

The pairs of actuators 12*a*, 12*b*, 12*c*, 12*d* are configured to respectively and independently move the screen elements 11*a*, 11*b*, 11*c*, 11*d*.

Each actuator 12*a*, 12*b*, 12*c*, 12*d* comprises a moving device 38 and transmission means 39 for transmitting the movement from the moving device 38 to the respective appendix 33, 34 of the respective screen element 11*a*, 11*b*, 11*c*, 11*d*.

The moving devices 38 are fixed to the second face 24 of the mobile plate 19. Each moving device 38 is preferably an electric motor equipped with a shaft 40 which crosses the mobile plate 19. In the non-limiting example here described and illustrated, the moving devices 38 are electric step motors. Shaft 40 of each motor is preferably arranged parallel to axis C. The transmission means 39 of each actuator 12*a*, 12*b*, 12*c*, 12*d* comprise a rod-crank type mechanism 41, a first guide assembly 42*a* and a second guide assembly 42*b*.

In particular, the rod-crank type mechanism 41 comprises a crank 43 connected to the shaft 40 of the respective moving device 38 and a rod 44 coupled with the respective connecting appendix 33, 34 of the respective screen element 11*a*, 11*b*, 11*c*, 11*d*.

The first guide assembly 42*a* guides the ends of the rods 44 connected to the appendixes 33, 34 of the first screen element 11*a* and of the second screen element 11*b* along direction D1, while the second guide assembly 42*b* guides the ends of the rods 44 connected to the appendixes 33, 34 of the third screen element 11*c* and of the fourth screen element 11*d* along direction D2.

The first guide assembly 42*a* comprises two plates 45, which, in use, face each other and are orthogonal to axis C, and are equipped with four grooves 46, adapted to being engaged by the respective rod 44, and with a central hole 47 for the light beam passage. The grooves 46 extend along direction D1.

The second guide assembly 42*b* comprises two plates 48, which, in use, face each other and are orthogonal to axis C, and are equipped with four grooves 49, adapted to being engaged by the respective rod 44, and with a central hole 50 for the light beam passage. The grooves 49 extend along direction D2.

It is understood that the guide function of the movement of the screen elements 11*a*, 11*b*, 11*c*, 11*d* may be satisfied by any guide assembly configured to guide the end of the rod 44 connected to the appendix 33, 34 in the movement direction of the respective screen element 11*a*, 11*b*, 11*c*, 11*d*.

The separating elements 14 are respectively arranged upstream and downstream from each screen element 11*a*, 11*b*, 11*c*, 11*d* along axis C to prevent the screen elements 11*a*, 11*b*, 11*c*, 11*d* from coming into contact with each other. In particular, a first separating element 14 is arranged between plate 45 and the first screen element 11*a*, a second separating element 14 is arranged between the first screen element 11*a* and the second screen element 11*b*, a third separating element 14 is arranged between the second screen element 11*b* and the plate 45, a fourth separating element 14 is arranged between the plate 48 and the third screen element 11*c*, a fifth separating element 14 is arranged between the third screen element 11*c* and the fourth screen element 11*d*, a sixth separating element 14 is arranged between the fourth screen element 11*d* and the plate 48.

Each separating element 14 is equipped with holes 51 for fixing the mobile plate 19 and with a central hole 52 for the light beam passage.

Advantageously, the use of the rod-crank type mechanism 41 makes the transmission means 39 less cumbersome than the transmission means used in the known art. Thus, the shaping assembly 6 according to the present invention has a smaller axial volume with respect to the shaping assemblies of the known art.

Furthermore, the particular arrangement of the screen elements 11*a*, 11*b*, 11*c*, 11*d* along distinct planes allows the complete screening of the light beam (so-called "total closure of the light beam") to be obtained through the movement of a single screen element 11*a*, 11*b*, 11*c*, 11*d*. Furthermore, such an arrangement along distinct planes allows shapes of the beam to be defined which require significantly translating and rotating each screen element 11*a*, 11*b*, 11*c*, 11*d*.

Lastly, it is apparent that modifications and variants may be made to the shaping assembly and to the light fixture here described without departing from the scope of the appended claims.

What is claimed is:

1. Shaping assembly for shaping a light beam extending along an optical axis comprising:

a support frame extending along a longitudinal axis;

a plurality of screen elements supported by the support frame and arranged transversally with respect to the optical axis, wherein each screen element has a first edge and a second edge; and a plurality of actuators; each actuator comprising a motor and transmission means which is configured to transmit the movement of the motor to the respective screen element, each screen element being connected to two actuators along the first edge of a respective screen element;

wherein the transmission means comprises at least a rod-crank type mechanism and first and second guide assemblies which are configured to guide the movement of the second edge of the respective screen element along a plurality of directions transversal to the optical axis, the second edge of the respective screen element intercepting the light beam.

2. Shaping assembly according to claim 1, wherein the screen elements are arranged along respective distinct planes orthogonal to the axis and are movable along said planes.

3. Shaping assembly according to claim 2, wherein the screen elements are movable along planes arranged in succession along the axis.

4. Shaping assembly according to claim 1, wherein each screen element is provided with a first appendix and a second appendix, which are coplanar and extend on opposite sides of the screen element.

5. Shaping assembly according to claim 4, wherein the first appendix is provided with a hole and the second appendix is provided with a slot.

6. Shaping assembly according to claim 4, wherein the first appendix and the second appendix are respectively coupled to the rod-crank type mechanisms of the respective two actuators.

7. Shaping assembly according to claim 4, wherein the transmission means is directly connected to the motor and one respective appendix.

8. Shaping assembly according to claim 4, wherein the two actuators comprise first and second motors with the first motor being connected to the first appendix and the second motor being connected to the second appendix.

9. Shaping assembly according to claim 1, wherein the first guide assembly comprises two plates, which, in use, faces each other and are orthogonal to the optical axis, and are provided with a plurality of grooves and with a central hole for the light beam passage.

10. Shaping assembly according to claim 9, wherein each transmission means directly engages one respective guide plate and is guided within one groove of the respective guide plate.

11. Shaping assembly according to claim 1, wherein the first guide assembly is configured to guide the movement of a first and a second screen element along a first direction and the second guide assembly is configured to guide the movement of a third and a fourth screen element along a second direction.

12. Shaping assembly according to claim 11, wherein the second direction is substantially orthogonal to the first direction.

13. Shaping assembly according to claim 1, wherein the support frame comprises a fixed plate and a mobile plate; the screen elements being supported by the mobile plate.

14. Stage light fixture comprising a shaping assembly according to claim 1.

15. Shaping assembly according to claim 1, wherein the two actuators are connected to the first edge of a respective screen panel at two different locations thereof.

16. Shaping assembly for shaping a light beam extending along an optical axis comprising:

a support frame extending along a longitudinal axis;

a plurality of screen elements supported by the support frame and arranged transversally with respect to the axis, each screen element having a first edge and a second edge;

a plurality of actuators, each screen element being connected to two actuators along the first edge of a respective screen element, each actuator being configured to operate independent from the other actuator connected to the respective screen element, each actuator comprising a motor including a shaft; a crank connected to said shaft; and a rod connected to the first edge of the respective screen element; and a guide assembly configured to guide each rod along a given path;

wherein a construction of the guide assembly and connection of two independently movable rods to the first edge of the respective screen element allows the respective screen element to be moved along a plurality of directions transversal to the optical axis, including inclination of the second edge of the respective screen element to permit positioning of the respective screen element such that the second edge intercepts the light beam.

17. Shaping assembly for shaping a light beam extending along an optical axis comprising:

a plurality of screen panels arranged transversally with respect to the optical axis, each screen panel having a first edge and a second edge;

a plurality of actuators, wherein two actuators are connected to the first edge of a respective screen panel at two different locations thereof, each actuator being configured to operate independent from the other, each actuator comprising a motor including a shaft; a crank connected to said shaft; and a rod connected to the first edge of the respective screen panel, wherein the connection of the two actuators to the first edge at two different locations and the independent operation of the two motors allow the second edge to be inclined such that the second edge intercepts the light beam; and first and second guide assemblies configured to guide the rods along a plurality of directions transversal to the optical axis.

* * * * *